United States Patent [19]

Vrsnak et al.

[11] 4,225,835

[45] Sep. 30, 1980

[54] ELECTROMAGNETIC SWITCHING RELAY

[75] Inventors: Franc Vršnak; Jurica Zadravec; Igor Pečenko, all of Ljubljana, Yugoslavia

[73] Assignee: Iskra Zp Ljubljana, O. Sub. O., Ljubljana, Yugoslavia

[21] Appl. No.: 851,749

[22] Filed: Nov. 15, 1977

[30] Foreign Application Priority Data

Nov. 15, 1976 [YU] Yugoslavia ..... 2791/76
Oct. 28, 1977 [YU] Yugoslavia ..... 2593/77

[51] Int. Cl.[3] ..... H01H 51/22
[52] U.S. Cl. ..... 335/78; 335/81
[58] Field of Search ..... 335/78, 79, 80, 81, 335/84, 85, 82

[56] References Cited

U.S. PATENT DOCUMENTS

| | | | |
|---|---|---|---|
| 1,953,929 | 4/1934 | Droysen | 335/82 |
| 3,946,347 | 3/1976 | Sauer | 335/202 |
| 3,987,383 | 10/1976 | Antonitsch | 335/78 |
| 4,075,585 | 2/1978 | Sauer | 335/78 |
| 4,091,346 | 5/1978 | Nishimura et al. | 335/78 |

*Primary Examiner*—George Harris
*Attorney, Agent, or Firm*—Fleit & Jacobson

[57] ABSTRACT

An electromagnetic relay having a switching sensitivity alterable under the influence of an external magnetic field. The relay comprises a coil form made from an insulating material. A plurality of pole-shoes, also acting as relay contacts, are mounted in the coil form. A plurality of ferromagnetic inlays which exhibit magnetic lines of force are mounted in the coil form so that each one of the inlays is associated with a corresponding one of the pole-shoes. When the inlays are mounted, the magnetic lines of force exhibited by these inlays are not perpendicular to the corresponding pole-shoes. A magnetic insulating region is formed by the coil form for partially insulating the pole-shoes from the lines of magnetic force exhibited by the corresponding inlay. The relay contains a substantially flat ferromagnetic armature which is switched into one of two positions in response to an excitation coil which is sensitive to an electrical current. When the relay is rotated relative to an external magnetic field, the components of the magnetic lines of force exhibited by the inlays vary, resulting in a corresponding variation in the switching sensitivity of the armature. A bearing assembly containing recesses in the form of a biconcave lens are also provided for mounting the armature.

4 Claims, 5 Drawing Figures

ELECTROMAGNETIC SWITCHING RELAY

Figure 1:
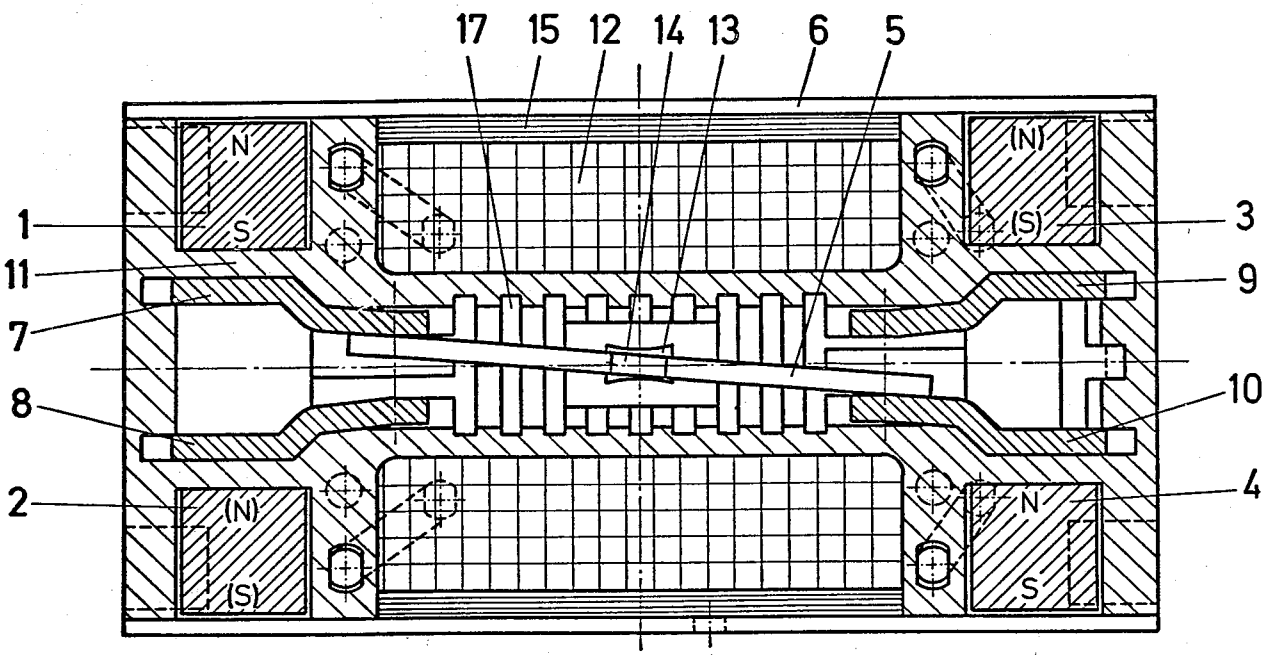

The invention relates to an electromagnetic switching relay having a coil form in which are mounted fixed pole-shoes, an excitation coil, as well as ferromagnetic inlays. The coil form is surrounded by a ferromagnetic yoke in the form of a U-shaped cap. In addition a flat ferromagnetic armature is provided inside the coil form.

A similar relay is known from the German publication DT-AS No. 2 461 884. Despite its good properties, this relay posesses a drawback which lies in that, for bistable operation, the relays construction is different from the one for monostable operation. An additional drawback of the relay, according to the above-mentioned publication, lies in the fact that the position of the armature in the longitudinal direction is not exactly defined and, consequently, in mounting the relay so that the armature is in vertical position, there arises the possibility that, due to outer shocks on the relay, the armature may slide downwards, with its lower end leaning against the lower magnet inlay or the coil form, which results in unreliability at switch-over. Further, the prior art relay neither permits changing of its sensitivity nor adjusting of this sensitivity to a prescribed value. The sensitivity cannot be kept within the same value due to the tolerance variations of the magnets built into the relay, as well as tolerances of other components. Consequently, it is necessary to select between these magnets and other components, which makes the production more expensive.

An object of the present invention is to provide the relay as described in the introduction, which does not possess the drawbacks of known embodiments. Its production should be simple and inexpensive, i.e. for a bistable as well as monostable embodiment, the same construction should be used. In this way neither the production process nor the production tools have to be changed. The finished relay should also permit an adjustment of the sensitivity. In addition, the invention has the object of providing a relay that, with minor change, may be used as a bistable relay or as a monostable relay in which the armature resting position is pronounced. All embodiments should also have the property that mounting is optional. In addition the relays should be insensitive to vibrational shocks from any direction. Such a relay should also have the property of reducing the possibility of the contacts getting dirty with dust particles, which are produced in the relays interior during its operation.

According to the invention the above-stated objects are attained with a relay comprising fixed pole-shoes, contacts therefor and contacts for an excitation coil, as well as ferromagnetic inlays, all of which are contained in a coil form. The coil form is surrounded by a ferromagnetic yoke in the form of a U-shaped cap. A flat ferromagnetic armature is provided inside the coil form.

In one embodiment, which is used as a bistable relay, all ferromagnetic inlays are permanent magnets, in the form of a parallelopiped and are polarized in the same direction. The ferromagnetic inlays, together with a ferromagnetic yoke and armature, form a magnetic bridge. In the second embodiment, which is used as a monostable relay, two oppositely positioned ferromagnetic inlays are parallelopipeds made of soft magnetic material, while the remaining ferromagnetic inlays are permanent magnets polarized in the same direction.

In an additional embodiment intended for use as a bistable relay, at one end of the armature the relay is embodied in the same manner as in the above-described bistable embodiment, while on the other end of the armature one permanent magnet, which is polarized in the opposite direction, is positioned between both pole-shoes.

In this additional embodiment, a monostable embodiment of the relay can be achieved by inserting an additional permanent magnet into the space between the yoke and one pole-shoe. The inserted magnet is polarized in the same direction as the magnet positioned between both pole-shoes.

To prevent longitudinal shifts, the armature, in its middle, possesses two lateral square-shaped extensions lying in the plane of the armature. These extensions reach into two bearings, which have a recess in the form of a profile of a biconcave lens. The extensions can, therefore, rotate within the bearings, while a longitudinal shift of the armature is completely prevented. In addition, the extension is kept very short in the longitudinal direction of the armature so that the armature has to overcome a very small torque when the edge of the extension leans on the inner wall of the bearing.

In order that the relay may be adjusted to the required sensitivity, a magnetic sensitivity adjustment is provided. As is well known, ceramic magnets which represent an economically logical solution for such relays, may be used to change the intensity of the magnetic field in the direction of the pole-shoe only by changing the effective component of this field or by changing the magnetizing direction of these magnets. This is accomplished by arranging a part of the coil form between each permanent magnet and the pole-shoe in order to create a partial magnetic insulation between the two. As a result, the lines of magnetic forces leave the magnet in a direction which is not perpendicular to the corresponding pole-shoe.

All through the operation of the relay, dust particles are formed by falling of nonmagnetic contact material and parts of plastic material of which the coil form is made. Inside the coil form, toroidal channels with a rectangular cross-section are made for collecting these dust particles in order to significantly reduce the possibility of dirt contacting the surfaces of the armature and the pole-shoes.

Figure 2:
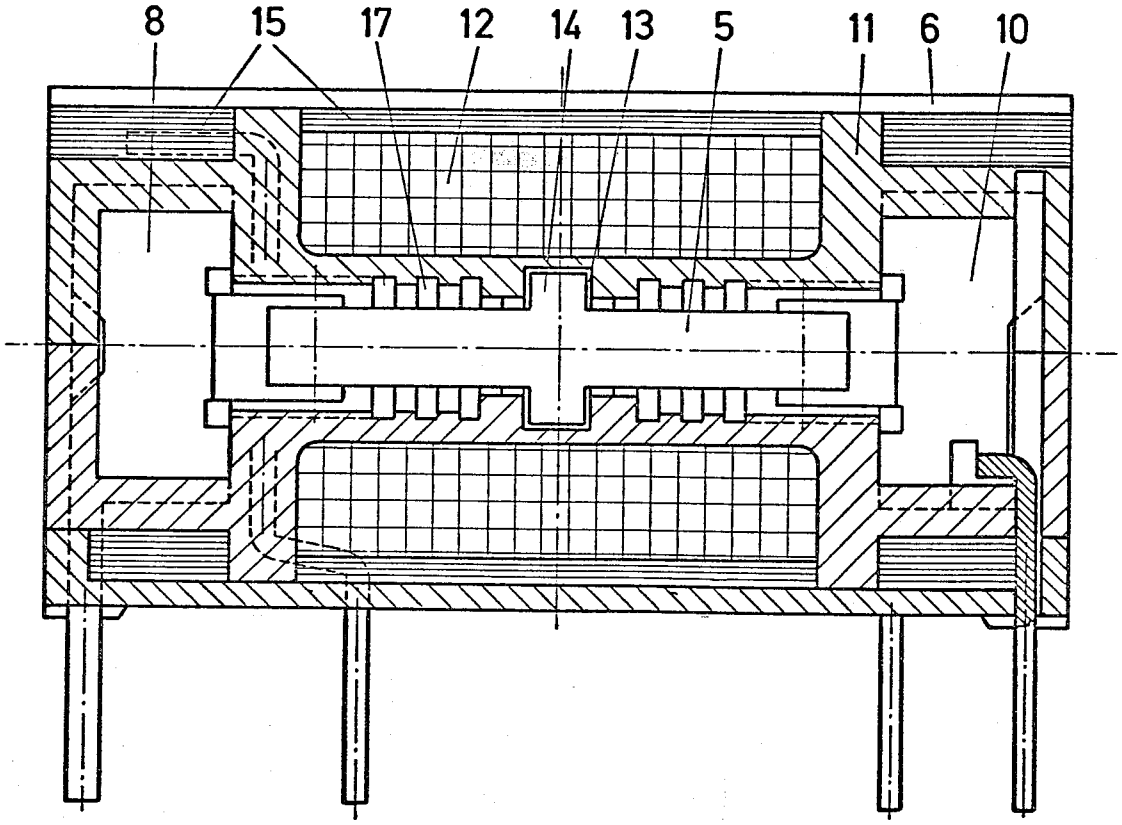
Figure 3:
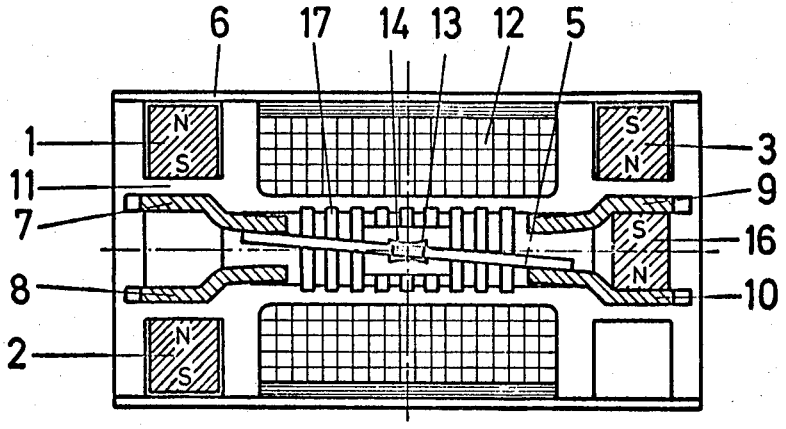
Figure 4:
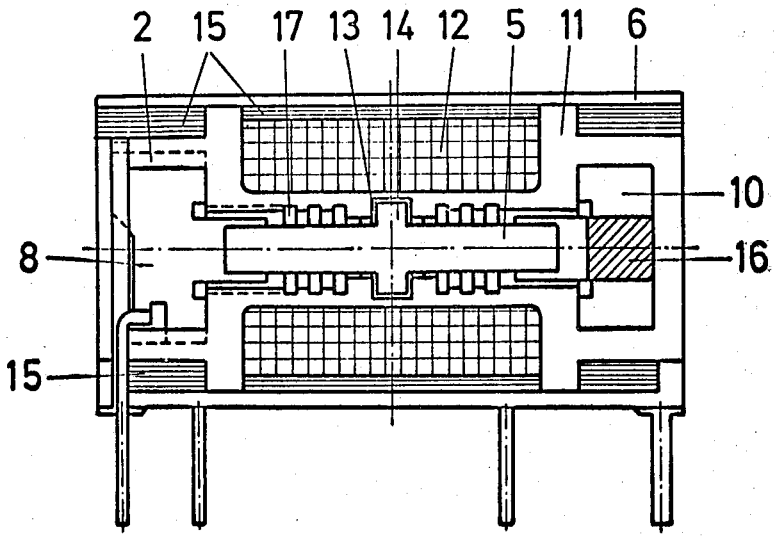
Figure 5:
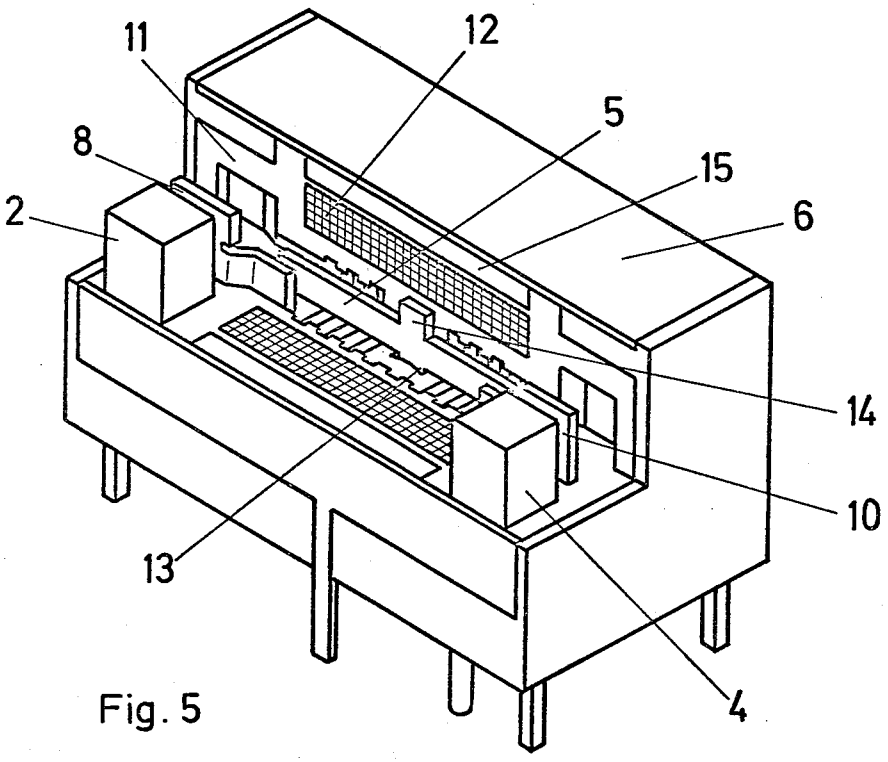

The invention is described in detail in accordance with the embodiments shown in the drawings. Therein show:

FIG. 1 the first embodiment of the relay according to the invention in an top view and in cross-section;

FIG. 2 the first embodiment of the relay according to the invention in a side view and in cross-section;

FIG. 3 the second embodiment of the relay according to the invention in an top view and in cross-section;

FIG. 4 the second embodiment of the relay according to the invention in a side view and in cross-section;

FIG. 5 the first embodiment of the relay according to the invention in an axonometric projection of the cross-section.

In FIGS. 1, 2 and 5 the first embodiment of the relay according to the invention is shown. The relay is composed of four ferromagnetic inlays 1, 2, 3 and 4, which in a bistable embodiment are all permanent magnets that are polarized in the same direction in a manner as shown in FIG. 1. Four ferromagnetic pole-shoes 7, 8, 9 and 10 are arranged near the ferromagnetic inlays 1, 2, 3 and 4, to provide electric contacts. Ferromagnetic inlays 1, 2, 3 and 4 are separated from the ferromagnetic pole-shoes 7, 8, 9 and 10 by the coil form 11 or another separating means to provide an electric and a partial magnetic insulation. The armature 5 is magnetically excited by the coil 12 which is arranged on the coil form 11. The armature 5 always connects two opposed ferromagnetic pole-shoes 7 and 10 or 8 and 9, which at the same time serve as electric contacts. The armature 5, which is electrically as well as magnetically conductive, is made of soft magnetic low resilient material, and is flat and cross-formed, so that its lateral extensions 14 enable a rotatable fastening in the bearings 13. The bearings 13 have a recess in the form of a profile of a biconcave lens. In this recess are positioned the extensions 14 of the armature 5. The horizontal diameter of the recess is a little larger that the width of the extension 14, whereby a tight leaning of the armature 5 against the pole-shoes 7, 8, 9 and 10 is possible in spite of broader manufacturing tolerances at the armature 5, pole-shoes 7, 8, 9 and 10 and the coil form 11.

If the diametrically opposed ferromagnetic inlays, e.g. 1 and 4, are permanent magnets and ferromagnetic inlays 2 and 3 are soft magnetic inlays, a monostable embodiment of the relay according to the invention is obtained. In the monostable embodiment, armature 5 normally contacts pole-shoes 7 and 10. When the coil 12 is excited, the armature then contacts pole-shoes 8 and 9.

As can be seen from FIGS. 1 and 3, between the individual pole-shoes 7, 8, 9 and 10 and the ferromagnetic inlays 1, 2, 3 and 4 which can be permanent magnets, a part of the coil form 11 is positioned, which prevents the lines of magnetic forces leaving the magnets from passing over completely to the individual pole-shoes 7, 8, 9 and 10, in this way making it possible to use permanent magnets that may possess a stray field. If the relay, according to the invention, is positioned in a magnetic field in such manner that this field is neither perpendicular to the plane of the armature 5 nor placed in the direction of the armature 5, then the individual permanent magnets, when they are ceramic magnets, will be magnetized in the direction of the lines of magnetic forces of the outer magnetic field. Therefore, their effective component which is placed in the direction of the pole-shoes will vary, whereby the sensitivity of the relay will vary too. By simultaneously controlling of the sensitivity of the relay and rotating thereof in the outer magnetic field, it is possible to vary the relay's switching sensitivity, which depends upon the amperage through the coil 12.

An additional embodiment of the relay according to the invention is shown in FIGS. 3 and 4. This relay has two permanent magnets 1 and 2 on one of its ends, like the relay shown in FIGS. 1 and 2. On the other end of the relay between both pole-shoes 9 and 10 there is inserted one single permanent magnet 16 which is polarized in the opposite direction. In this embodiment the relay is a bistable relay which differs from the basic embodiment insofar as only three permanent magnets are used. By providing another permanent magnet 3, which is positioned on the same side as the magnet 16 in the space between the yoke 6 and the pole-shoe 9 and is polarized in the same direction as the magnet 16, a monostable embodiment is obtained. This monostable embodiment differs from the monostable embodiment of FIGS. 1 and 2 in so far as the resting position of the armature 5 of this additional version is much more pronounced. The reason for this lies in the fact that in the resting position of the armature 5, the attractive forces of the magnets 1, 3 and 16 add together, whereas in the opposite position, obtained with an appropriate excitation of the coil 12, the attractive forces of the magnets 1 and 16 add together, and the attractive forces of the magnets 2 and 3 compensate each other.

Although these additional embodiments of relays do not readily lend themselves to a magnetic adjustment of the sensitivity thereof, a properly constructed magnetizing apparatus which limits the influence of the outer magnetic field generally to one half of the relay, would make such a magnetic adjustment possible.

The channels 17, which are made inside the coil form 11, are preferably made in such manner that they possess as large a surface area as possible. The channels provide a convenient means for collecting dust falling off from the contacts due to their mutual impact. Therefore, these channels have a toroidal form and a rectangular cross section.

Preferably, the armature 5 and the pole-shoes 7, 8, 9 and 10, which are made of soft magnetic material, are coated with a thicker metal layer with low ohmic resistance or are provided with contact elements, e.g. contact rivets, whereby the contact resistance is reduced and the reliability of operation is improved.

The electromagnetic relay according to the invention is hermetically sealed in known manner with a sealing material 15 and is filled with an inert gas.

What is claimed is:

1. An electromagnetic switching relay having a switching sensitivity alterable under the influence of an external magnetic field, said relay comprising:

a coil form made from an insulating material;

a plurality of pole-shoes mounted in said coil form, said pole-shoes, also, acting as relay contacts.

a plurality of ferromagnetic inlays which exhibit magnetic lines of force, each one of said inlays being associated with a corresponding one of said pole-shoes, said inlays being mounted in said coil form so that the lines of force are not perpendicular to the corresponding pole-shoe;

a magnetic insulating means formed by said coil form for partially insulating said pole-shoes from the lines of force exhibited by said corresponding inlay;

a substantially flat ferromagnetic armature mounted for transverse rotation within said coil form, said armature operable in a first position for providing a conductive path between a number of pole-shoes and in a second position for providing a conductive path between a different number of pole-shoes; and excitation coil means, surrounding a portion of said coil form and said armature, said coil means being sensitive to an electrical current for switching said armature to at least one of said two positions, wherein, upon rotation of said relay relative to said external magnetic field, the components of the lines of force exhibited by said inlays vary, resulting in a corresponding variation in the switching sensitivity of said armature, further comprising toroidal channels with a rectangular cross-section made inside the coil form.

2. An electromagnetic relay having a switching sensitivity alterable under the influence of an external magnetic field, said relay comprising:

a coil form made from an insulating material;

a plurality of pole-shoes mounted in said coil form, said pole-shoes, also, acting as relay contacts;

a plurality of ferromagnetic inlays which exhibit magnetic lines of force, each one of said inlays being associated with a corresponding one of said pole-shoes, said inlays being mounted in said coil form so that the lines of force are not perpendicular to the corresponding pole-shoe;

a magnetic insulating means formed by said coil form for partially insulating said pole-shoes from the lines of force exhibited by said corresponding inlay;

a substantially flat ferromagnetic armature mounted for transverse rotation within said coil form, said armature operable in a first position for providing a conductive path between a number of pole-shoes and in a second position for providing a conductive path between a different number of pole-shoes; and excitation coil means, surrounding a portion of said coil form and said armature, said coil means being sensitive to an electrical current for switching said armature to at least one of said two positions, wherein, upon rotation of said relay relative to said external magnetic field, the components of the lines of force exhibited by said inlays vary, resulting in a corresponding variation in the switching sensitivity of said armature, wherein said plurality of pole-shoes is four pole-shoes arranged in pairs, and said plurality of inlays is two inlays which are permanent magnets both polarized in the same direction each one of said two inlays being associated with a corresponding pole-shoe in one of said pole-shoe pairs, and further comprising a third permanent magnet positioned between the pole shoes of said other pole-shoe pair, said third permanent magnet being polarized in a direction opposite to the direction of said permanent magnets.

3. The electromagnetic switching relay of claim 2, further comprising a yoke, and a fourth permanent magnet positioned between said yoke and one of said pole-shoes of said other pair, said forth permanent magnet being polarized in the same direction as said third permanent magnet.

4. An electromagnetic switching relay having a switching sensitivity alterable under the influence of an external magnetic field, said relay comprising:

a coil form made from an insulating material;

a plurality of pole-shoes mounted in said coil form, said pole-shoes, also, acting as relay contacts;

a plurality of ferromagnetic inlays which exhibit magnetic lines of force, each one of said inlays being associated with a corresponding one of said pole-shoes, said inlays being mounted in said coil form so that the lines of force are not perpendicular to the corresponding pole shoe;

a magnetic insulating means formed by said coil form for partially insulating said pole-shoes from the lines of force exhibited by said corresponding inlay;

a substantially flat ferromagnetic armature mounted for transverse rotation within said coil form, said armature operable in a first position for providing a conductive path between a number of pole-shoes and in a second position for providing a conductive path between a different number of pole-shoes; and excitation coil means, surrounding a portion of said coil form and said armature, said coil means being sensitive to an electrical current for switching said armature to at least one of said two positions, wherein, upon rotation of said relay relative to said external magnetic field, the components of the lines of force exhibited by said inlays vary, resulting in a corresponding variation in the switching sensitivity of said armature, further comprising a square-shaped extension projecting laterally from each side of said armature within a plane defined by the flat portion of said armature, and a pair of bearings formed in said coil form, each having a recess in the form of a profile of a biconcave lens for rotatably mounting one of said extensions.

* * * * *